US009355648B2

(12) United States Patent
Tsujikawa et al.

(10) Patent No.: US 9,355,648 B2
(45) Date of Patent: May 31, 2016

(54) VOICE INPUT/OUTPUT DEVICE, METHOD AND PROGRAMME FOR PREVENTING HOWLING

(71) Applicants: Masanori Tsujikawa, Minato-ku (JP); Satoshi Tsukada, Minato-ku (JP); Eiji Takada, Minato-ku (JP)

(72) Inventors: Masanori Tsujikawa, Minato-ku (JP); Satoshi Tsukada, Minato-ku (JP); Eiji Takada, Minato-ku (JP)

(73) Assignee: NEC CORPORATION, Tokyo (JP)

( * ) Notice: Subject to any disclaimer, the term of this patent is extended or adjusted under 35 U.S.C. 154(b) by 141 days.

(21) Appl. No.: 14/354,840

(22) PCT Filed: Oct. 31, 2012

(86) PCT No.: PCT/JP2012/006985

§ 371 (c)(1),
(2) Date: Apr. 28, 2014

(87) PCT Pub. No.: WO2013/069229

PCT Pub. Date: May 16, 2013

(65) Prior Publication Data

US 2014/0324418 A1 Oct. 30, 2014

(30) Foreign Application Priority Data

Nov. 9, 2011 (JP) ..... 2011-245615

(51) Int. Cl.
*G10L 21/034* (2013.01)
*G10L 21/0272* (2013.01)
*G10L 21/0364* (2013.01)
(Continued)

(52) U.S. Cl.
CPC ..... *G10L 21/034* (2013.01); *G10L 21/0272* (2013.01); *G10L 21/0364* (2013.01); *H04R 3/02* (2013.01); *G10L 13/00* (2013.01); *G10L 2015/225* (2013.01); *H04R 1/1083* (2013.01); *H04R 3/005* (2013.01); *H04R 2410/05* (2013.01)

(58) Field of Classification Search
CPC ..... G10L 13/00; G10L 2015/225; G10L 21/0272; G10L 21/034; G10L 21/0364
USPC ..... 704/225, 226, 233, E21.006, E21.004; 379/406.08; 381/94.7
See application file for complete search history.

(56) References Cited

U.S. PATENT DOCUMENTS

| | | | | |
|---|---|---|---|---|
| 7,099,821 | B2 * | 8/2006 | Visser et al. | 704/226 |
| 7,191,124 | B2 * | 3/2007 | Kaminuma | 704/225 |
| 2012/0263317 | A1 * | 10/2012 | Shin et al. | 381/94.7 |

FOREIGN PATENT DOCUMENTS

| | | | |
|---|---|---|---|
| JP | 2958930 | B2 | 10/1999 |
| JP | 2009-94707 | A | 4/2009 |
| JP | 4360212 | B2 | 11/2009 |

*Primary Examiner* — Charlotte M Baker
(74) *Attorney, Agent, or Firm* — Sughrue Mion, PLLC

(57) ABSTRACT

A voice separation means 82 separates an input voice of a volume adjusted by an input volume adjustment means 81, into a voice recognition voice and a monitoring voice. A monitoring volume adjustment means 83 adjusts a volume of the monitoring voice. An output volume adjustment means 84 adjusts a volume of an output voice and causes an output device to output the output voice of the adjusted volume, the output voice being a voice obtained by synthesizing a synthetic voice and the monitoring voice of the volume adjusted by the monitoring volume adjustment means 83, the synthetic voice being a voice synthesized from information generated as a result of voice recognition of the voice recognition voice. A control means 85 instructs the monitoring volume adjustment means 83 to adjust the volume of the monitoring voice so that an amplification factor of the volume of the output voice with respect to the volume of the input voice does not exceed 1.

20 Claims, 6 Drawing Sheets

(51) Int. Cl.

| | | | |
|---|---|---|---|
| ***H04R 3/02*** | (2006.01) | *H04R 3/00* | (2006.01) |
| *H04R 1/10* | (2006.01) | *G10L 15/22* | (2006.01) |
| | | *G10L 13/00* | (2006.01) |

VOICE INPUT/OUTPUT DEVICE, METHOD AND PROGRAMME FOR PREVENTING HOWLING

This application is a National Stage of International Application No. PCT/JP2012/006985, filed on Oct. 31, 2012, which claims priority from Japanese Patent Application No. 2011-245615, filed on Nov. 9, 2011, the contents of all of which are incorporated herein by reference in their entirety.

TECHNICAL FIELD

The present invention relates to a voice input/output device for preventing howling when outputting an input voice and a result of voice recognition of the voice, and a method and a programme for preventing howling.

BACKGROUND ART

A voice input/output device that includes a voice input device such as a microphone and a voice output device such as a headphone, for example, a headset microphone, is known. A voice-based data input device that: recognizes a voice input from a voice input device to convert the voice into text; converts the text of the recognition result into a voice; and outputs the voice from a voice output device is also known. By checking the voice (hereafter referred to as "synthetic voice") obtained by converting the text of the recognition result, the user can determine whether or not the voice produced by the user is appropriately recognized.

In other words, in the case of checking (hereafter also referred to as "monitoring") the input voice using the above-mentioned data input device, the data input device outputs not only the synthetic voice but also the input voice to the voice output device.

FIG. 10 is an explanatory diagram depicting an example of the data input device. In the example depicted in FIG. 10, when a voice produced by the user is input to a microphone 71, the voice is output from a speaker 72. The voice produced by the user is simultaneously input to a voice recognition/synthesis device 73, and a synthetic voice generated by a voice recognition and voice synthesis process is output from the speaker 72, too.

On reason for monitoring the input voice from the voice input device by the voice output device is to ensure that the voice can be input from the voice input device. Another reason is to prevent a decrease in voice recognition rate due to the Lombard effect when speaking in a loud environment. In the case where a headphone is used as the voice output device, the user's ears are covered and so the user might not be able to hear an ambient sound. Even in such a case, outputting the input voice from the voice input device to the voice output device (headphone) enables the user to hear the ambient sound.

Typically, the timing at which the voice input to the voice input device is output and the timing at which the synthetic voice is output are different. This is because a predetermined processing time is taken for voice recognition when generating the synthetic voice. Accordingly, the user hears the synthetic voice a predetermined time after he or she produces the voice.

In the voice input/output device that combines the voice input device and the voice output device, the balance between the voice input level and output level needs to be adjusted in order to prevent howling. Various methods for adjusting these levels are known.

Patent Literature (PTL) 1 describes a karaoke machine having a function of adjusting a microphone used to input a singing voice. In the karaoke machine described in PTL 1, when adjusting the microphone volume or effect, a singer's voice is converted by PCM (Pulse Code Modulation), and the converted data is recorded as a voice. The singer adjusts the microphone volume while repeatedly playing the recorded voice, and records the voice again. This saves the need for the user to repeatedly producing the voice.

PTL 2 describes a karaoke machine that prevents howling by automatically adjusting voices output from a plurality of speakers. The karaoke machine described in PTL 2 prevents howling by, in accordance with the relation between a predetermined speaker position and a designated microphone position, lowering the microphone input voice signal level or lowering the mixing level upon output from each speaker.

CITATION LIST

Patent Literature(s)

PTL 1: Japanese Patent No. 4360212
PTL 2: Japanese Patent No. 2958930

SUMMARY OF INVENTION

Technical Problem

In the above-mentioned data input device, the input voice is monitored by outputting the input voice from the voice output device. However, howling might occur in the case where the sound from the voice output device leaks into the voice input device, as in the karaoke machine. In detail, howling might occur if the sound from the voice output device leaks into the voice input device and the leaking sound is further amplified and output from the voice output device.

A simplest method for preventing howling is to lower the volumes of the voice input device and the voice output device. However, lowering the volume of the voice input device has a possibility of causing a decrease in voice recognition accuracy, and lowering the volume of the voice output device has a possibility of causing the synthetic voice to be less audible.

In the case of the karaoke machine described in PTL 1, the user needs to detect the occurrence of howling and adjust the volume each time. In other words, in the case of using the karaoke machine described in PTL 1, the user needs to adjust the volume each time so as not to cause howling. There is thus a problem that howling cannot be prevented easily.

Howling can be prevented by lowering the volume level, as in the karaoke machine described in PTL 2. There is, however, a problem that lowering the input level has a possibility of causing a decrease in voice recognition accuracy and lowering the output level has a possibility of causing the output synthetic voice to be less audible, as noted above.

In view of this, the present invention has an exemplary object of providing a voice input/output device and a method and a programme for preventing howling that, in the case where a result of voice recognition of an input voice is monitored together with the input voice, can easily prevent howling without causing a decrease in voice recognition accuracy for the input voice and without causing a synthetic voice, which is output as a result of voice recognition of the input voice, to be less audible.

Solution to Problem

A voice input/output device according to the present invention is a voice input/output device including: an input volume adjustment means for adjusting a volume of an input voice input to an input device; a voice separation means for separating the input voice of the volume adjusted by the input volume adjustment means, into a voice recognition voice which is a voice used for voice recognition and a monitoring voice which is a voice used for monitoring the input voice; a monitoring volume adjustment means for adjusting a volume of the monitoring voice; an output volume adjustment means for adjusting a volume of an output voice and causing an output device to output the output voice of the adjusted volume, the output voice being a voice obtained by synthesizing a synthetic voice and the monitoring voice of the volume adjusted by the monitoring volume adjustment means, the synthetic voice being a voice synthesized from information generated as a result of voice recognition of the voice recognition voice; and a control means for instructing the monitoring volume adjustment means to adjust the volume of the monitoring voice so that an amplification factor of the volume of the output voice with respect to the volume of the input voice does not exceed 1.

A method for preventing howling according to the present invention is a method for preventing howling, including: adjusting a volume of an input voice input to an input device; separating the input voice of the adjusted volume, into a voice recognition voice which is a voice used for voice recognition and a monitoring voice which is a voice used for monitoring the input voice; adjusting a volume of the monitoring voice; adjusting a volume of an output voice and causing an output device to output the output voice of the adjusted volume, the output voice being a voice obtained by synthesizing a synthetic voice and the monitoring voice of the adjusted volume, the synthetic voice being a voice synthesized from information generated as a result of voice recognition of the voice recognition voice; and adjusting the volume of the monitoring voice so that an amplification factor of the volume of the output voice with respect to the volume of the input voice does not exceed 1.

A programme for preventing howling according to the present invention is a programme for preventing howling, causing a computer to execute: an input volume adjustment process of adjusting a volume of an input voice input to an input device; a voice separation process of separating the input voice of the volume adjusted in the input volume adjustment process, into a voice recognition voice which is a voice used for voice recognition and a monitoring voice which is a voice used for monitoring the input voice; a monitoring volume adjustment process of adjusting a volume of the monitoring voice; an output volume adjustment process of adjusting a volume of an output voice and causing an output device to output the output voice of the adjusted volume, the output voice being a voice obtained by synthesizing a synthetic voice and the monitoring voice of the volume adjusted in the monitoring volume adjustment process, the synthetic voice being a voice synthesized from information generated as a result of voice recognition of the voice recognition voice; and a control process of adjusting the volume of the monitoring voice so that an amplification factor of the volume of the output voice with respect to the volume of the input voice does not exceed 1.

Advantageous Effects of Invention

According to the present invention, in the case where a result of voice recognition of an input voice is monitored together with the input voice, howling can be prevented easily without causing a decrease in voice recognition accuracy for the input voice and without causing a synthetic voice, which is output as a result of voice recognition of the input voice, to be less audible.

DESCRIPTION OF EMBODIMENT(S)

Exemplary embodiments of the present invention are described below, with reference to drawings.

Exemplary Embodiment 1

Figure 1:
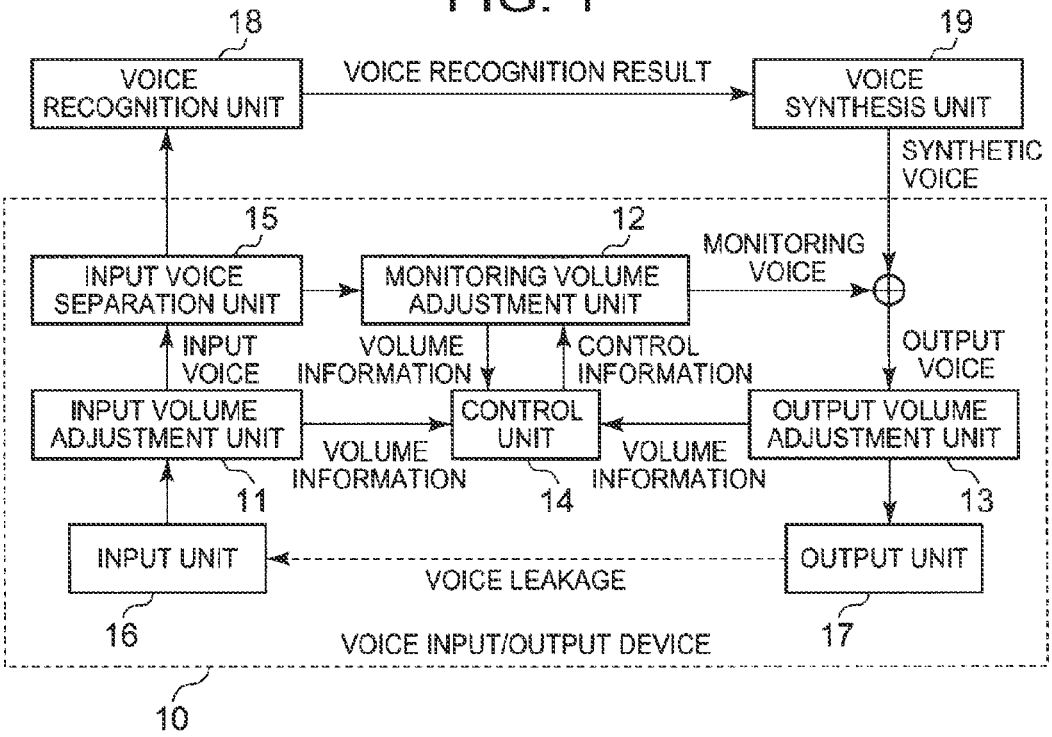
FIG. 1 It depicts a block diagram depicting an example of a structure of Exemplary Embodiment 1 of a voice input/output device according to the present invention.

FIG. 1 is a block diagram depicting an example of a structure of Exemplary Embodiment 1 of a voice input/output device according to the present invention. A voice input/output device 10 in this exemplary embodiment includes an input volume adjustment unit 11, a monitoring volume adjustment unit 12, an output volume adjustment unit 13, a control unit 14, an input voice separation unit 15, an input unit 16, and an output unit 17.

The voice input/output device 10 communicates with a voice recognition unit 18 and a voice synthesis unit 19. The communication between the voice input/output device 10 and each of the voice recognition unit 18 and the voice synthesis unit 19 may be wireless communication or wired communication. Alternatively, the voice input/output device 10 may include the voice recognition unit 18 and the voice synthesis unit 19. This exemplary embodiment supposes that the voice recognition unit 18 and the voice synthesis unit 19 are provided in a device other than the voice input/output device 10.

The input unit 16 is an input device for inputting a user's voice or an ambient sound. The input unit 16 is realized, for example, by a microphone. The input unit 16 inputs the input voice to the input volume adjustment unit 11. The input unit 16 may input an analog signal indicating the input voice, directly to the input volume adjustment unit 11. Alternatively, the input unit 16 may perform A/D (Analog/Digital) conversion on the voice indicated by the analog signal, and input a digital signal as a result of conversion to the input volume adjustment unit 11.

The input volume adjustment unit 11 adjusts the volume of the voice input to the input unit 16. The input volume adjustment unit 11 includes a volume designation unit (not depicted) such as an operation panel used for volume designation, and adjusts the input volume according to an operation by the user on the volume designation unit.

For example, in the case where the input voice is converted into the digital signal, the input volume adjustment unit 11 may adjust the volume by changing the value indicated by the digital signal. In the case where the voice received from the input unit 16 is the analog signal, the input volume adjustment unit 11 may adjust the volume when A/D converting the input voice. Since the method of adjusting the volume is widely known, its detailed description is omitted. The input volume adjustment unit 11 inputs the input voice of the adjusted volume to the input voice separation unit 15.

The input voice separation unit 15 separates the input voice of the volume adjusted by the input volume adjustment unit 11, into a voice (hereafter referred to as "voice recognition voice") used for a voice recognition process by the voice recognition unit 18 and a voice (hereafter referred to as "monitoring voice") used for monitoring the input voice. In detail, the input voice separation unit 15 duplicates digital data indicating the input voice received from the input volume adjustment unit 11, and inputs the duplicated digital data to each of the voice recognition unit 18 and the monitoring volume adjustment unit 12.

The input voice separation unit 15 may receive an instruction indicating whether or not to use the monitoring function, from the user. For example, the input voice separation unit 15 may input the input voice to the monitoring volume adjustment unit 12 in the case of receiving an instruction "to use the monitoring function" from the user, and not input the input voice to the monitoring volume adjustment unit 12 in the case of receiving an instruction "not to use the monitoring function" from the user.

This exemplary embodiment describes the case where the input volume adjustment unit 11 inputs the volume-adjusted input voice to the input voice separation unit 15 and the input voice separation unit 15 inputs the input voice to each of the voice recognition unit 18 and the monitoring volume adjustment unit 12. Note that the input volume adjustment unit 11 may have the function of the input voice separation unit 15. That is, the input volume adjustment unit 11 may input the input voice to each of the voice recognition unit 18 and the monitoring volume adjustment unit 12.

The monitoring volume adjustment unit 12 adjusts the volume of the monitoring voice received from the input voice separation unit 15, in the same way as the input volume adjustment unit 11. The monitoring volume adjustment unit 12 may adjust the volume of the monitoring voice according to an instruction by the user. The monitoring volume adjustment unit 12 also adjusts the volume of the monitoring voice according to an instruction by the below-mentioned control unit 14. In the case where the volume adjustment instruction by the user and the volume adjustment instruction by the control unit 14 are both made, the monitoring volume adjustment unit 12 gives a higher priority to the instruction by the control unit 14. The monitoring volume adjustment unit 12 inputs the monitoring voice of the adjusted volume to the output volume adjustment unit 13.

The voice recognition unit 18 performs the voice recognition process based on the voice received from the input voice separation unit 15. The voice recognition unit 18 then inputs a voice recognition result to the voice synthesis unit 19. The voice recognition unit 18 performs the voice recognition process using a typical method. For instance, the voice recognition unit 18 may convert the voice recognition result into text, and input the text to the voice synthesis unit 19. The detailed description of the voice recognition process is omitted here.

The voice synthesis unit 19 generates a synthetic voice from the voice recognition result received from the voice recognition unit 18. The voice synthesis unit 19 then inputs the generated synthetic voice to the output volume adjustment unit 13. The voice synthesis unit 19 performs the voice synthesis process using a typical method. The detailed description of the voice synthesis process is omitted here.

The output volume adjustment unit 13 adjusts the volume of a voice (hereafter referred to as "output voice") that combines the synthetic voice received from the voice synthesis unit 19 and the monitoring voice received from the monitoring volume adjustment unit 12, in the same way as the input volume adjustment unit 11. That is, the output volume adjustment unit 13 includes a volume designation unit (not depicted) such as an operation panel used for volume designation, and adjusts the output volume according to an operation by the user on the volume designation unit.

The output volume adjustment unit 13 inputs the volume-adjusted output voice to the output unit 17. The output volume adjustment unit 13 may D/A convert the output voice and input an analog signal as a result of conversion to the output unit 17. Alternatively, the output volume adjustment unit 13 may input a digital signal indicating the volume-adjusted output voice directly to the output unit 17. In this case, the output unit 17 includes a D/A converter.

The output unit 17 outputs the output voice received from the output volume adjustment unit 13. The output unit 17 is realized, for example, by a speaker.

The control unit 14 instructs the monitoring volume adjustment unit 12 to adjust the volume of the monitoring voice. In detail, the control unit 14 instructs the monitoring volume adjustment unit 12 to adjust the volume of the monitoring voice so that the amplification factor of the volume of the output voice output from the output unit 17 with respect to the volume of the input voice input to the input unit 16 does not exceed 1.

Howling occurs as a result of amplifying the output voice. In other words, howling can be prevented if the amplification factor of the volume of the output voice with respect to the volume of the input voice does not exceed 1. Hence, such control that keeps the volume amplification factor from exceeding 1 is performed to prevent howling.

In detail, the control unit 14 receives, from each of the input volume adjustment unit 11, the monitoring volume adjustment unit 12, and the output volume adjustment unit 13, information (hereafter also referred to as "volume information") indicating the ratio (amplification factor) at which the volume is changed in the adjustment unit. The control unit 14 adjusts the amplification factor of the monitoring volume adjustment unit 12 so that the amplification factor of the volume of the output voice with respect to the volume of the input voice does not exceed 1, based on the received amplification factor in each adjustment unit.

Figure 2:
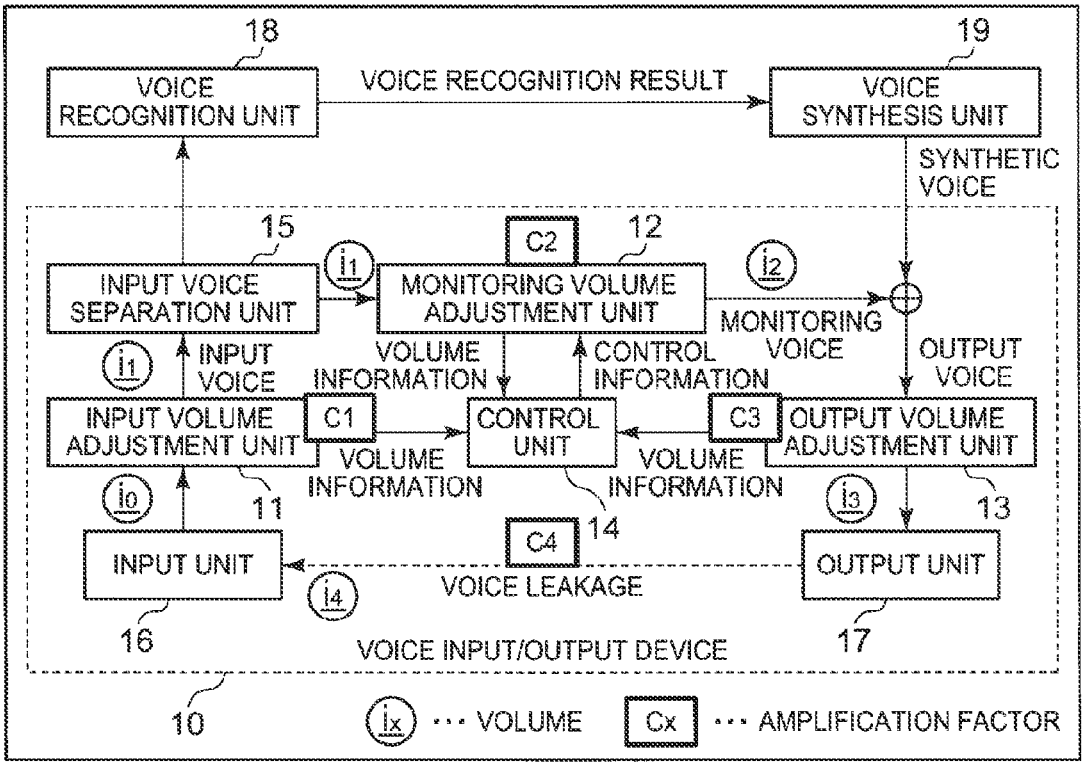
FIG. 2 It depicts an explanatory diagram depicting relations of volume amplification factors.

FIG. 2 is an explanatory diagram depicting relations of volume amplification factors. Let $C_1$ be the amplification factor adjusted in the input volume adjustment unit 11, $C_2$ be the amplification factor adjusted in the monitoring volume adjustment unit 12, and $C_3$ be the amplification factor adjusted in the output volume adjustment unit 13. Let $i_0$ be the volume of the voice input to the input volume adjustment unit 11, $i_1$ be the volume of the voice output from the input volume adjustment unit 11 and input to the monitoring volume adjustment unit 12, $i_2$ be the volume of the voice output from the monitoring volume adjustment unit 12 and input to the output volume adjustment unit 13, and $i_3$ be the volume output from the output volume adjustment unit 13.

Moreover, let $C_4$ be the amplification factor of the voice input to the input unit 16 with respect to the voice output from the output unit 17. The amplification factor $C_4$ is determined by the characteristics of the output unit 17 (speaker), the transfer characteristics from the output unit 17 (speaker) to the input unit 16 (microphone), the characteristics of the input unit 16 (microphone), and the like. Though an actual measurement value may be used as the amplification factor $C_4$, the amplification factor $C_4$ can be assumed to be 1 at the maximum because energy attenuates in the case where there is no amplification circuit while the sound output from the output unit 17 leaks into the input unit 16.

In this case, $i_1=C_1i_0$, $i_2=C_2i_1=C_1C_2i_0$, $i_3=C_3i_2=C_1C_2C_3i_0$, and $i_4=C_4i_3<i_3$ hold true. Since $i_0>i_4$ needs to be satisfied, it is necessary to satisfy $i_0>i_3=C_1C_2C_3i_0$, that is, $C_1C_2C_3<1$. The control unit 14 accordingly controls the amplification factor in the monitoring volume adjustment unit 12 so as to satisfy the condition "$C_2<(1/C_1C_3)$".

In detail, as long as $C_2<(1/C_1C_3)$ is satisfied, the monitoring volume adjustment unit 12 can adjust the amplification factor according to the volume adjustment instruction by the user. In the case where the amplification factor $C_2$ that does not satisfy $C_2<(1/C_1C_3)$ is instructed, however, the control unit 14 instructs the monitoring volume adjustment unit 12 to adjust the amplification factor to $C_2<(1/C_1C_3)$.

The input volume adjustment unit 11, the monitoring volume adjustment unit 12, the output volume adjustment unit 13, and the control unit 14 are realized by a CPU of a computer operating according to a programme (voice input/output programme). For example, the programme may be stored in a storage unit (not depicted) in the voice input/output device 10, with the CPU reading the programme and, according to the programme, operating as the input volume adjustment unit 11, the monitoring volume adjustment unit 12, the output volume adjustment unit 13, and the control unit 14.

Alternatively, the input volume adjustment unit 11, the monitoring volume adjustment unit 12, the output volume adjustment unit 13, and the control unit 14 may each be realized by dedicated hardware. In detail, the input volume adjustment unit 11, the monitoring volume adjustment unit 12, and the output volume adjustment unit 13 may each include a volume designation unit (not depicted) such as an operation panel used for volume designation.

Figure 3:
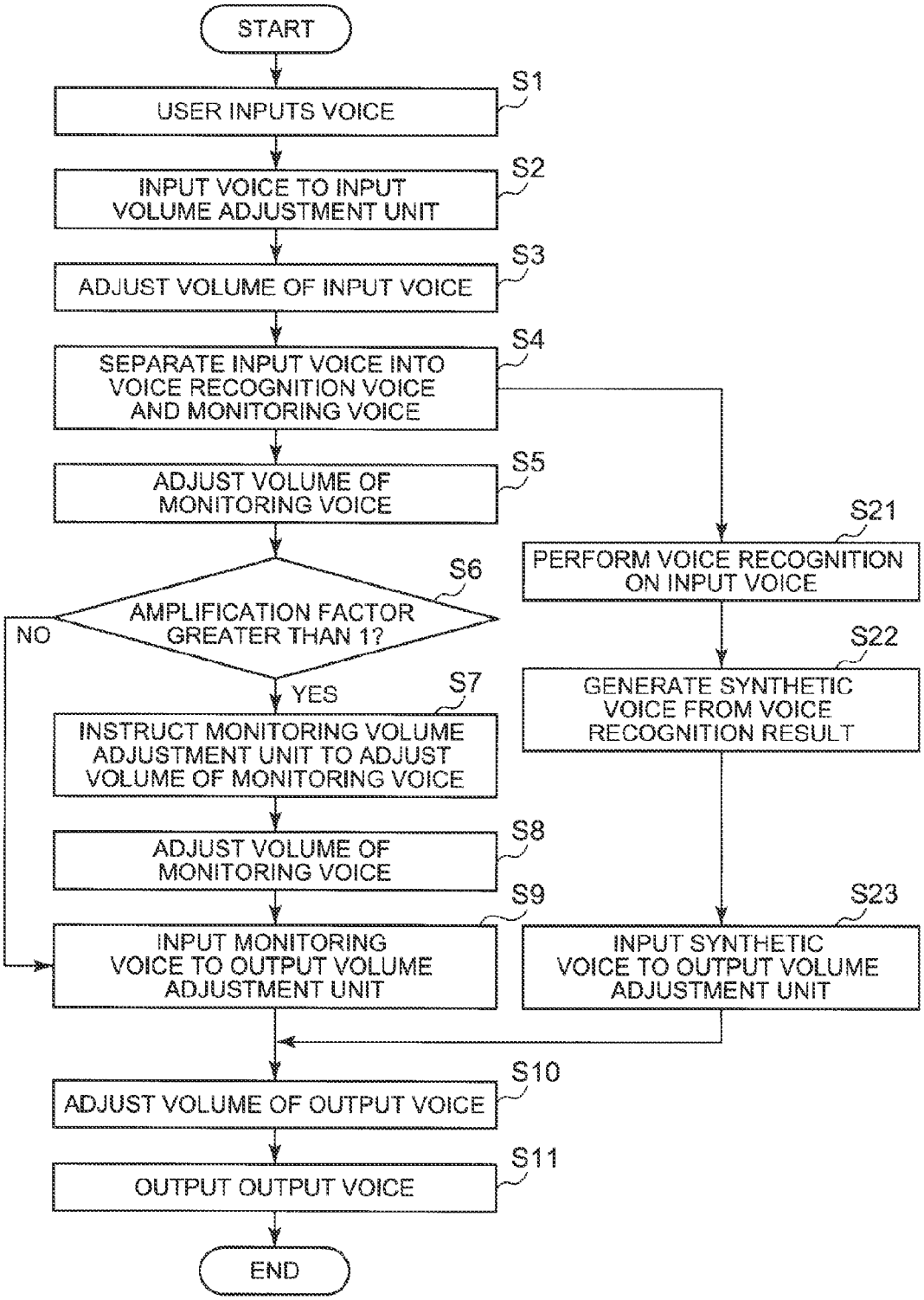
FIG. 3 It depicts a flowchart depicting an example of an operation of a voice input/output device in Exemplary Embodiment 1.

The following describes an operation of the voice input/output device in this exemplary embodiment. FIG. 3 is a flowchart depicting an example of the operation of the voice input/output device in this exemplary embodiment.

When the user inputs the voice to the input unit 16 (step S1), the input unit 16 inputs the input voice to the input volume adjustment unit 11 (step S2). The input volume adjustment unit 11 adjusts the input voice to the volume designated by the user (step S3). The input voice separation unit 15 separates the input voice of the volume adjusted by the input volume adjustment unit 11, into the voice recognition voice and the monitoring voice (step S4). The input voice separation unit 15 transmits the voice recognition voice to the voice recognition unit 18, and inputs the monitoring voice to the monitoring volume adjustment unit 12. Here, the input voice separation unit 15 may transmit the voice recognition voice to the voice recognition unit 18 wirelessly.

The voice recognition unit 18 performs voice recognition on the received input voice (step S21). The voice synthesis unit 19 generates the synthetic voice from the result of voice recognition by the voice recognition unit 18 (step S22), and inputs the generated synthetic voice to the output volume adjustment unit 13 (step S23).

Meanwhile, the monitoring volume adjustment unit 12, in the case where the volume of the monitoring voice is designated by the user, adjusts the monitoring voice to the designated volume (step S5).

The control unit 14 determines whether or not the amplification factor of the volume of the output voice output from the output unit 17 with respect to the volume of the input voice input to the input unit 16 exceeds 1 (step S6). In the case where the amplification factor exceeds 1 (YES in step S6), the control unit 14 instructs the monitoring volume adjustment unit 12 to adjust the volume of the monitoring voice so that the amplification factor does not exceed 1 (step S7). In this case, the monitoring volume adjustment unit 12 adjusts the volume of the monitoring voice according to the instruction by the control unit 14 (step S8), and inputs the volume-adjusted monitoring voice to the output volume adjustment unit 13 (step S9).

In the case where the amplification factor does not exceed 1 (NO in step S5), the control unit 14 issues no instruction to the monitoring volume adjustment unit 12. The monitoring volume adjustment unit 12 accordingly inputs the monitoring voice of the volume designated by the user, to the output volume adjustment unit 13 (step S9).

The output volume adjustment unit 13 adjusts the volume of the output voice that combines the synthetic voice and the monitoring voice, to the volume designated by the user (step S10). The output volume adjustment unit 13 inputs the volume-adjusted output voice to the output unit 17. The output unit 17 outputs the volume-adjusted output voice.

As described above, according to this exemplary embodiment, the input volume adjustment unit 11 adjusts the volume of the input voice input to the input unit 16. The input voice separation unit 15 separates the input voice of the adjusted volume into the voice recognition voice and the monitoring voice. The monitoring volume adjustment unit 12 adjusts the volume of the monitoring voice. The output volume adjustment unit 13 adjusts the volume of the output voice obtained by synthesizing the synthetic voice and the volume-adjusted monitoring voice, and causes the output unit 17 to output the volume-adjusted output voice. The control unit 14 adjusts the volume of the monitoring voice so that the amplification factor of the volume of the output voice with respect to the volume of the input voice does not exceed 1.

Therefore, in the case where a result of voice recognition of an input voice is monitored together with the input voice, howling can be prevented easily without causing a decrease in voice recognition accuracy for the input voice and without causing a synthetic voice, which is output as a result of voice recognition of the input voice, to be less audible.

Exemplary Embodiment 2

Figure 4:
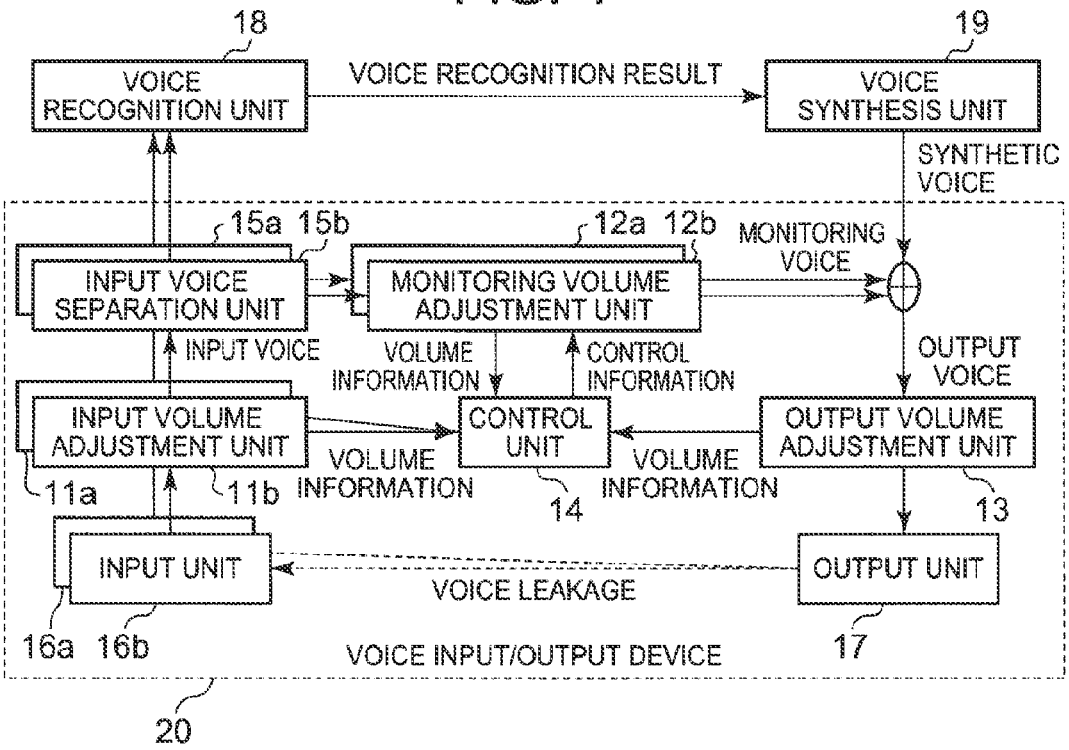
FIG. 4 It depicts a block diagram depicting an example of a structure of Exemplary Embodiment 2 of a voice input/output device according to the present invention.

FIG. 4 is a block diagram depicting an example of a structure of Exemplary Embodiment 2 of a voice input/output device according to the present invention. The same components as those in Exemplary Embodiment 1 are given the same signs as in FIG. 1, and their description is omitted.

A voice input/output device 20 in this exemplary embodiment differs from the voice input/output device 10 in Exemplary Embodiment 1, in that it includes at least two input units 16 (input units 16*a*, 16*b*), input volume adjustment units 11 (input volume adjustment units 11*a*, 11*b*) corresponding to the input units 16, and monitoring volume adjustment units 12 (monitoring volume adjustment units 12*a*, 12*b*) corresponding to the input volume adjustment units 11. The other structure is the same as that in Exemplary Embodiment 1.

Though two input units 16, two input volume adjustment units 11, and two monitoring volume adjustment units 12 are depicted in FIG. 4 as an example, the number of input units 16, input volume adjustment units 11, and monitoring volume adjustment units 12 is not limited to two, and may be three or more.

Though the monitoring volume adjustment units 12 are respectively provided for the input units 16 in FIG. 4 as an example, the number of monitoring volume adjustment unit 12 may be one, so long as it is capable of adjusting the volume of the monitoring voice separated for each input voice.

In this exemplary embodiment, too, howling can be prevented if the amplification factor of the volume of the output voice with respect to the volume of the input voice does not exceed 1. Accordingly, the volume of the input voice can be considered for each input unit 16. The control unit 14 therefore instructs the monitoring volume adjustment unit 12 to adjust the volume of the monitoring voice so that the amplification factor of the volume of the output voice with respect to the volume of each input voice does not exceed 1.

Let $C_{1a}$ and $C_{1b}$ be the amplification factors respectively adjusted in the input volume adjustment units 11*a* and 11*b*, $C_{2a}$ and $C_{2b}$ be the amplification factors respectively adjusted in the monitoring volume adjustment units 12*a* and 12*b*, and $C_3$ be the amplification factor adjusted in the output volume adjustment unit 13. Let $i_{0a}$ and $i_{0b}$ be the volumes of the voices respectively input to the input volume adjustment units 11*a* and 11*b*, $i_{1a}$ and $i_{1b}$ be the volumes of the voices respectively output from the input volume adjustment units 11*a* and 11*b* and input to the monitoring volume adjustment units 12, $i_{2a}$ and $i_{2b}$ be the volumes of the voices respectively output from the monitoring volume adjustment units 12*a* and 12*b* and input to the output volume adjustment unit 13, and $i_3$ be the volume output from the output volume adjustment unit 13.

It is assumed that the voice output from the output unit 17 is input to each of the input units 16*a* and 16*b* with the volume $i_3$. That is, it is assumed that the amplification factor of the voice input to the input unit 16 with respect to the voice output from the output unit 17 is 1. In this case, $i_{0a}>i_3$ and $i_{0b}>i_3$ need to be satisfied. Summarizing in the same way as in Exemplary Embodiment 1 yields the following expression.

$$(1-C_{1a}C_{2a}C_3)(1-C_{1b}C_{2b}C_3)>(C_{1a}C_{2a}C_3)(C_{1b}C_{2b}C_3),$$

i.e.

$$(C_{1a}C_{2a}+C_{1b}C_{2b})C_3<1.$$

Accordingly, the control unit 14 adjusts the amplification factors in the monitoring volume adjustment units 12*a* and 12*b* so as to satisfy the expression given above.

In this exemplary embodiment, too, the input voice separation unit 15 may receive an instruction indicating whether or not to use the monitoring function, from the user. For example, in the case where an input voice separation unit 15 corresponding to an input unit 16 receives an instruction "to use the monitoring function" from the user, the input voice separation unit 15 may input the input voice input to the corresponding input unit 16, to the monitoring volume adjustment unit 12. In the case where the input voice separation unit 15 corresponding to the input unit 16 receives an instruction "not to use the monitoring function" from the user, on the other hand, the input voice separation unit 15 may not input the input voice input to the corresponding input unit 16, to the monitoring volume adjustment unit 12.

Though this exemplary embodiment describes the case where the input voice separation unit 15 is provided for each input unit 16, the number of input voice separation units 15 may be one. In this case, the input voice separation unit 15 may include a switch for designating an input unit 16 to which a voice to be monitored is input, and input only the voice input to the input unit 16 designated by the switch, to the monitoring volume adjustment unit 12.

Thus, in this exemplary embodiment, in the case where there are a plurality of input units 16 (microphones), one or more input units 16 may be selected to output monitoring voices. In the case where one input unit 16 is selected, the operation is the same as that in Exemplary Embodiment 1.

As described above, according to this exemplary embodiment, the plurality of input volume adjustment units 11 adjust the volumes of the input voices input to the respective input units 16. The monitoring volume adjustment unit 12 adjusts the volume of the monitoring voice separated for each input voice. The control unit 14 instructs the monitoring volume adjustment unit 12 to adjust the volume of the monitoring voice so that the amplification factor of the volume of the output voice with respect to the volume of each input voice does not exceed 1. As a result, howling can also be prevented in the case where the process is performed using a plurality of input voices input via a plurality of input devices, in addition to the advantageous effects of Exemplary Embodiment 1.

Exemplary Embodiment 3

Figure 5:
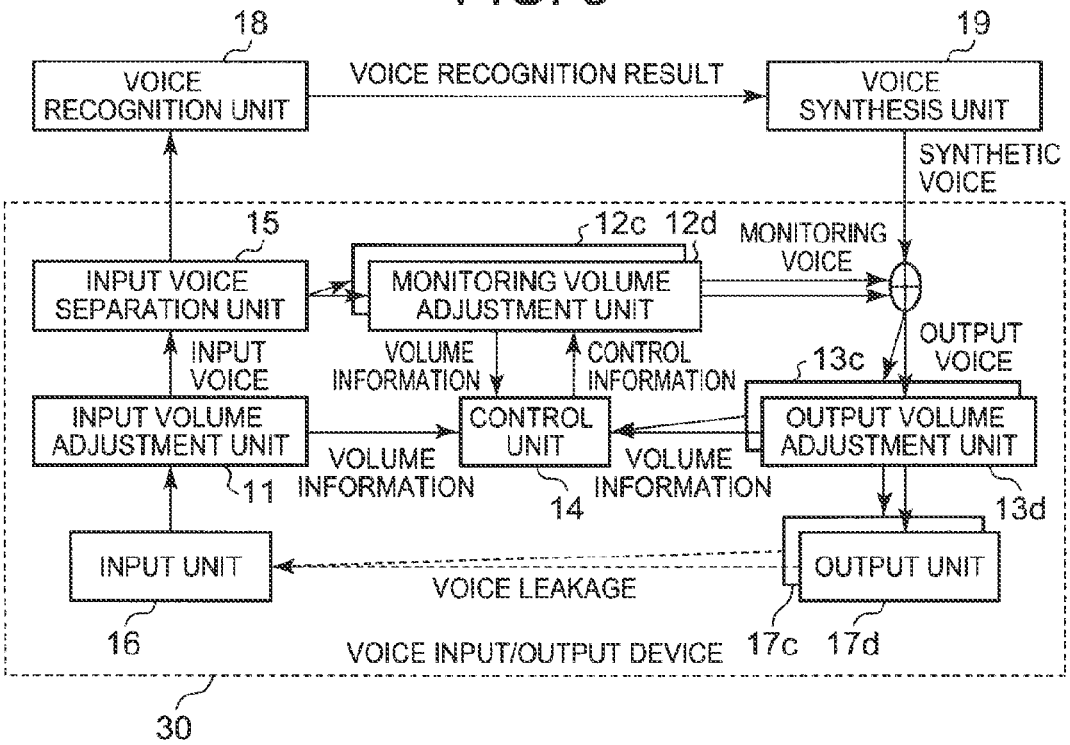
FIG. 5 It depicts a block diagram depicting an example of a structure of Exemplary Embodiment 3 of a voice input/output device according to the present invention.

FIG. 5 is a block diagram depicting an example of a structure of Exemplary Embodiment 3 of a voice input/output device according to the present invention. The same components as those in Exemplary Embodiment 1 are given the same signs as in FIG. 1, and their description is omitted.

A voice input/output device 30 in this exemplary embodiment differs from the voice input/output device 10 in Exemplary Embodiment 1, in that it includes at least two output units 17 (output units 17*c* and 17*d*), output volume adjustment units 13 (output volume adjustment units 13*c* and 13*d*) corresponding to the output units 17, and monitoring volume adjustment units 12 (monitoring volume adjustment units 12*c*, 12*d*) corresponding to the output volume adjustment units 13. The other structure is the same as that in Exemplary Embodiment 1.

Though two output units 17, two output volume adjustment units 13, and two monitoring volume adjustment units 12 are depicted in FIG. 5 as an example, the number of output units 17, output volume adjustment units 13, and monitoring volume adjustment units 12 is not limited to two, and may be three or more.

Though the monitoring volume adjustment units 12 are respectively provided for the output units 17 in FIG. 5 as an example, the number of monitoring volume adjustment unit 12 may be one, so long as it is capable of adjusting the volume of the monitoring voice for each output unit 17.

In this exemplary embodiment, howling can be prevented if the amplification factor of the total volume of the output voice output from each output unit 17 with respect to the volume of the input voice does not exceed 1. Accordingly, the volume of the input voice can be considered in relation to the total volume of the voices output from the output units 17. The control unit 14 therefore instructs the monitoring volume adjustment unit 12 to adjust the volume of the monitoring voice so that the amplification factor of the total volume of the output voice output from each output unit 17 with respect to the volume of the input voice does not exceed 1.

Let $C_1$ be the amplification factor adjusted in the input volume adjustment unit 11, $C_{2c}$ and $C_{2d}$ be the amplification factors respectively adjusted in the monitoring volume adjustment units 12*c* and 12*d*, and $C_{3c}$ and $C_{3d}$ be the amplification factors respectively adjusted in the output volume adjustment units 13*c* and 13*d*. Let $i_0$ be the volume of the voice input to the input volume adjustment unit 11, $i_1$ be the volume of the voice output from the input volume adjustment unit 11 and input to the monitoring volume adjustment units 12*c* and 12*d*, $i_{2c}$ and $i_{2d}$ be the volumes of the voices respectively output from the monitoring volume adjustment units 12*c* and 12*d* and input to the output volume adjustment units 13*c* and 13*d*, and $i_{3c}$ and $i_{3d}$ be the volumes respectively output from the output volume adjustment units 13*c* and 13*d*.

It is assumed that the voices output from the output units 17*c* and 17*d* are input to the input unit 16 with the volume $i_{3c}+i_{3d}$. That is, it is assumed that the amplification factor of the voice input to the input unit 16 with respect to the voices output from the output units 17*c* and 17*d* is 1. In this case, $i_0>i_{3c}+i_{3d}$ needs to be satisfied. Summarizing in the same way as in Exemplary Embodiment 1 yields the following expression.

$$C_1(C_{2c}C_{3c}+C_{2d}C_{3d})<1.$$

Accordingly, the control unit 14 adjusts the amplification factors of the monitoring volume adjustment units 12*c* and 12*d* so as to satisfy the expression given above.

In this exemplary embodiment, each output volume adjustment unit 13 may receive an instruction indicating whether or not to output the voice to the corresponding output unit 17. For example, in the case where an output volume adjustment unit 13 corresponding to an output unit 17 receives an instruction "to output voice" from the user, the output volume adjustment unit 13 may output the synthetic voice to the corresponding output unit 17. In the case where the output volume adjustment unit 13 corresponding to the output unit 17 receives an instruction "not to output voice" from the user, on the other hand, the output volume adjustment unit 13 may not output the synthetic voice to the corresponding output unit 17.

As described above, according to this exemplary embodiment, the plurality of output volume adjustment units 13 adjust the volumes of the output voices output from the respective output units 17. The monitoring volume adjustment unit 12 adjusts the volume of the monitoring voice for each output unit 17. The control unit 14 instructs the monitoring volume adjustment unit 12 to adjust the volume of the monitoring voice so that the amplification factor of the total volume of the output voice output from each output unit 17 with respect to the volume of the input voice does not exceed 1. As a result, howling can also be prevented in the case where voices are output from a plurality of output devices, in addition to the advantageous effects of Exemplary Embodiment 1.

Exemplary Embodiment 4

Figure 6:
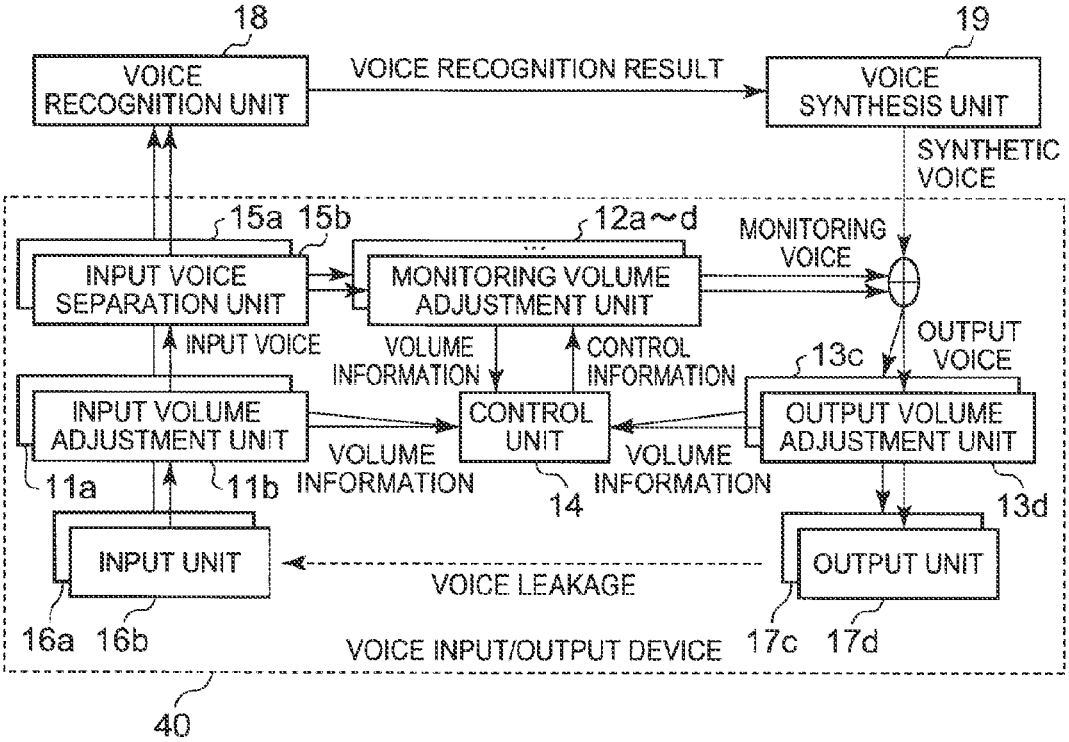
FIG. 6 It depicts a block diagram depicting an example of a structure of Exemplary Embodiment 4 of a voice input/output device according to the present invention.

FIG. 6 is a block diagram depicting an example of a structure of Exemplary Embodiment 4 of a voice input/output device according to the present invention. The same components as those in Exemplary Embodiments 1 to 3 are given the same signs as in FIGS. 1, 4, and 5, and their description is omitted.

A voice input/output device 40 in this exemplary embodiment includes the control unit 14, at least two input units 16 (input units 16*a*, 16*b*), input volume adjustment units 11 (input volume adjustment units 11*a*, 11*b*) corresponding to the input units 16, monitoring volume adjustment units 12 (monitoring volume adjustment units 12*a*, 12*b*) corresponding to the input volume adjustment units 11, at least two output units 17 (output units 17*c* and 17*d*), output volume adjustment units 13 (output volume adjustment units 13*c* and 13*d*) corresponding to the output units 17, and monitoring volume adjustment units 12 (monitoring volume adjustment units 12*c*, 12*d*) corresponding to the output volume adjustment units 13.

The process in the case where voices are input to the plurality of input units 16 is the same as that in Exemplary Embodiment 2. The process in the case where voices are output from the plurality of output units 17 is the same as that in Exemplary Embodiment 3.

In this exemplary embodiment, a combination of one or more input units 16 for inputting a voice and one or more output units 17 for outputting a synthetic voice may be selected to output a monitoring voice. For example, a combination of one or more input units 16 for inputting a voice and one or more output units 17 for outputting a synthetic voice may be selected by each input voice separation unit 15 receiving an instruction indicating whether or not to use the monitoring function and also each output volume adjustment unit 13 receiving an instruction indicating whether or not to output a voice to the corresponding output unit 17.

In this case, the monitoring volume adjustment unit 12 may adjust the volume of the monitoring voice separated for the input voice input to each selected input unit 16, and the volume of the monitoring voice for each selected output unit 17. The control unit 14 may then instruct the monitoring volume adjustment unit 12 to adjust the volume of the monitoring voice so that the amplification factor of the total volume of the output voice output from each selected output unit 17 with respect to the volume of the input voice input to each selected input unit 16 does not exceed 1. As a result, howling can also be prevented in the case where the process is performed using a plurality of input voices and also voices are output from a plurality of output units.

Example

The following describes the present invention by way of a specific example, though the scope of the present invention is not limited to the following.

Figure 7:
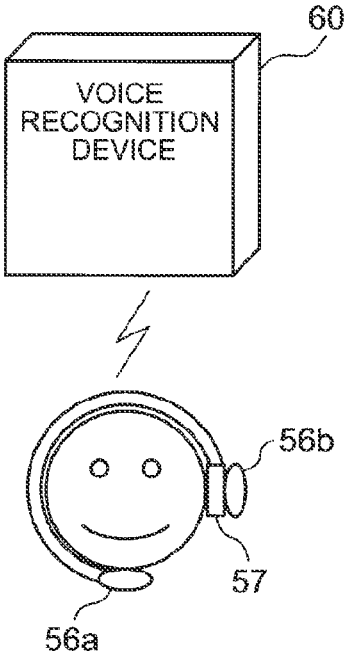
FIG. 7 It depicts an explanatory diagram depicting an example of a voice input/output device.

FIG. 7 is an explanatory diagram depicting an example of a voice input/output device in this example. A voice input/output device 50 in this example has an input unit and an output unit contained in one enclosure. In detail, the voice input/output device 50 includes two microphones 56*a* and 56*b* as input units, and one speaker 57 as an output unit. Of the two microphones 56*a* and 56*b*, one microphone 56*a* is placed at the user's mouth, and the other microphone 56*b* is placed at the user's ear. The speaker 57 is also placed at the user's ear.

A voice recognition device 60 performs voice recognition and voice synthesis. The voice input/output device 50 transmits sounds input to the microphones 56*a* and 56*b*, to the voice recognition device 60 by wireless communication. The voice input/output device 50 also receives a synthetic voice from the voice recognition device 60 by wireless communication.

The microphone 56*a* is used especially to input the user's voice, and the microphone 56*b* is used to input ambient noise. The voice recognition device 60 has a function of extracting the user's voice, by removing the ambient noise input to the microphone 56*b* from the sound included in the microphone 56*a*. The voice recognition device 60 also has a function of recognizing the user's voice to generate the synthetic voice. The method of extracting the user's voice from two sound sources and recognizing the extracted voice to generate the synthetic voice in this way is widely known, and so its description is omitted here.

Figure 8:
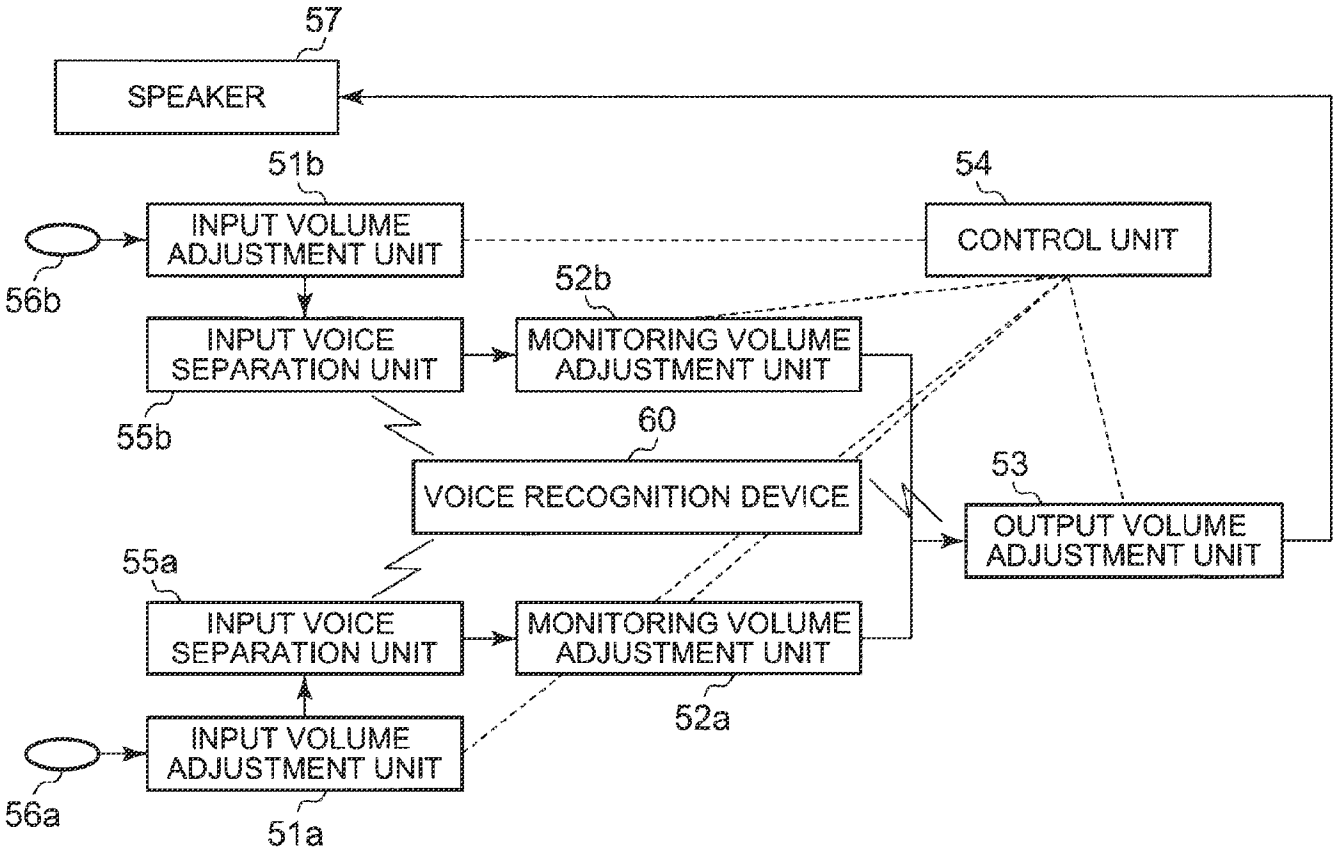
FIG. 8 It depicts an explanatory diagram depicting an example of a voice recognition system including the voice input/output device of the example.

FIG. 8 is an explanatory diagram depicting an example of a voice recognition system including the voice input/output device in this example. An input volume adjustment unit 51*a* is connected to the microphone 56*a*, and an input voice separation unit 55*a* is connected to the input volume adjustment unit 51*a*. The input voice separation unit 55*a* separates the voice input to the microphone 56*a*, and transmits the input voice to each of the voice recognition device 60 and a monitoring volume adjustment unit 52*a*. The voice recognition device 60 wirelessly transmits the synthetic voice as a result of voice recognition, to an output volume adjustment unit 53. The monitoring volume adjustment unit 52*a* transmits the monitoring voice to the output volume adjustment unit 53.

Likewise, an input volume adjustment unit 51*b* is connected to the microphone 56*b*, and an input voice separation unit 55*b* is connected to the input volume adjustment unit 51*b*. The input voice separation unit 55*b* separates the voice input to the microphone 56*b*, and transmits the input voice to each of the voice recognition device 60 and a monitoring volume adjustment unit 52*b*. The voice recognition device 60 wirelessly transmits the synthetic voice as a result of voice recognition, to the output volume adjustment unit 53. The monitoring volume adjustment unit 52*b* transmits the monitoring voice to the output volume adjustment unit 53.

The output volume adjustment unit 53 inputs the adjusted output voice to the speaker 57. The speaker 57 outputs the output voice. Here, a control unit 54 controls the monitoring volume adjustment units 52*a* and 52*b*.

In detail, in the case where the volume of the output voice output from the speaker 57 is greater than the volume of the input voice input to the microphone 56*a*, the control unit 54 instructs the monitoring volume adjustment unit 52*a* to adjust the volume of the monitoring voice so that the volume of the output voice is less than or equal to the volume of the input voice.

Likewise, in the case where the amplification factor of the volume of the output voice output from the speaker 57 with respect to the volume of the input voice input to the microphone 56*b* exceeds 1, the control unit 54 instructs the monitoring volume adjustment unit 52*b* to adjust the volume of the monitoring voice so that the amplification factor does not exceed 1.

In this example, the microphone 56*b* for collecting ambient noise and the speaker 57 are placed near each other at the user's ear. In such a case, the sound output from the speaker 57 tends to be directly input to the microphone 56*b*, which is likely to cause howling. However, in this example, in the case where the amplification factor of the volume of the output voice output from the speaker with respect to the volume of the input voice input to the microphone exceeds 1, the volume of the monitoring voice is adjusted so that the amplification factor does not exceed 1. Howling can be prevented in this way.

Figure 9:
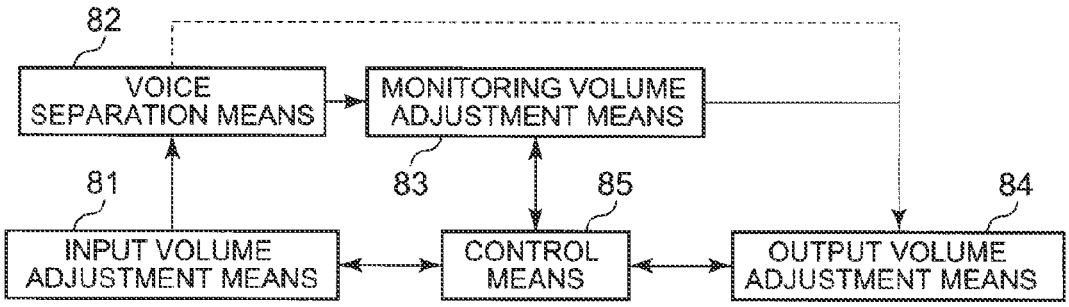
FIG. 9 It depicts a block diagram depicting an example of a minimum structure of a voice input/output device according to the present invention.
Figure 10:
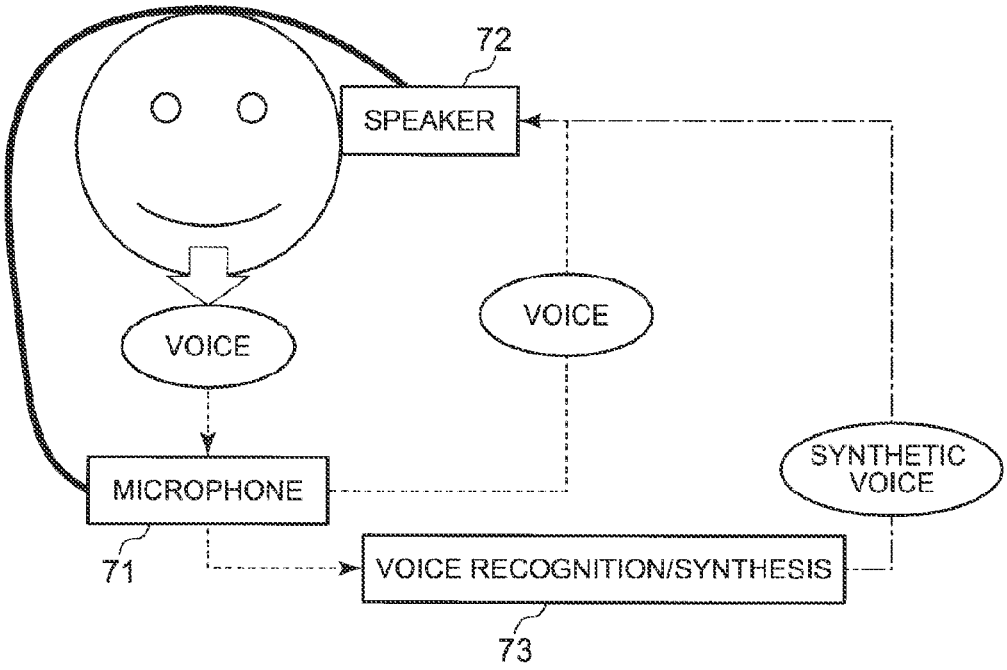
FIG. 10 It depicts an explanatory diagram depicting an example of a data input device.

The following describes an example of a minimum structure according to the present invention. FIG. 9 is a block diagram depicting an example of a minimum structure of a voice input/output device according to the present invention. The voice input/output device according to the present invention includes: an input volume adjustment means 81 (e.g. the input volume adjustment unit 11) for adjusting a volume of an input voice input to an input device (e.g. the input unit 16, microphone); a voice separation means 82 (e.g. the input voice separation unit 15) for separating the input voice of the volume adjusted by the input volume adjustment means 81, into a voice recognition voice which is a voice used for voice recognition and a monitoring voice which is a voice used for monitoring the input voice; a monitoring volume adjustment means 83 (e.g. the monitoring volume adjustment unit 12) for adjusting a volume of the monitoring voice; an output volume adjustment means 84 (e.g. the output volume adjustment unit 13) for adjusting a volume of an output voice and causing an output device (e.g. the output unit 17, speaker) to output the output voice of the adjusted volume, the output voice being a voice obtained by synthesizing a synthetic voice and the monitoring voice of the volume adjusted by the monitoring volume adjustment means 83, the synthetic voice being a voice synthesized from information generated as a result of voice recognition of the voice recognition voice; and a control means 85 (e.g. the control unit 14) for instructing the monitoring volume adjustment means 83 to adjust the volume of the monitoring voice so that an amplification factor of the volume of the output voice with respect to the volume of the input voice does not exceed 1.

According to such a structure, in the case where a result of voice recognition of an input voice is monitored together with the input voice, howling can be prevented easily without causing a decrease in voice recognition accuracy for the input voice and without causing a synthetic voice, which is output as a result of voice recognition of the input voice, to be less audible.

Moreover, the voice input/output device may include at least two input volume adjustment means (e.g. the input volume adjustment units 11*a*, 11*b*) respectively provided for at least two input devices, each for adjusting a volume of an input voice input to a corresponding input device. The monitoring volume adjustment means 83 may adjust a volume of a monitoring voice separated for each input voice. The control means 85 may instruct the monitoring volume adjustment means 83 to adjust the volume of the monitoring voice so that the amplification factor of the volume of the output voice with respect to the volume of each input voice does not exceed 1.

According to such a structure, howling can also be prevented in the case where the process is performed using a plurality of input voices input via a plurality of input devices.

Moreover, the voice input/output device may include at least two output volume adjustment means (e.g. the output volume adjustment units 13*c*, 13*d*) respectively provided for at least two output devices, each for adjusting a volume of an output voice output from a corresponding output device. The monitoring volume adjustment means 83 may adjust a volume of a monitoring voice for each output device. The control means 85 may instruct the monitoring volume adjustment means 83 to adjust the volume of the monitoring voice so that an amplification factor of a total volume of the output voice output from each output device with respect to the volume of the input voice does not exceed 1.

According to such a structure, howling can also be prevented in the case where voices are output from a plurality of output units.

Moreover, the voice input/output device may include a selection means (e.g. the input voice separation unit 15, the output volume adjustment unit 13) for selecting a combination of an input device to which an input voice is input and an output device from which a synthetic voice is output. The monitoring volume adjustment means 83 may adjust a volume of a monitoring voice separated for the input voice input to each selected input device, and a volume of a monitoring voice for each selected output device. The control means 85 may instruct the monitoring volume adjustment means 83 to adjust the volume of the monitoring voice so that an amplification factor of a total volume of the output voice output from each selected output device with respect to a volume of the input voice input to each selected input device does not exceed 1.

According to such a structure, howling can also be prevented in the case where the process is performed using a plurality of input voices and voices are output from a plurality of output units.

Moreover, the voice separation means 82 may transmit the voice recognition voice to a voice recognition device wirelessly, and the output volume adjustment means 84 may receive the synthetic voice transmitted wirelessly.

Moreover, the voice input/output device may include: a voice recognition means (e.g. the voice recognition unit 18) for performing voice recognition based on the voice recognition voice; and a voice synthesis means (e.g. the voice synthesis unit 19) for generating the synthetic voice from a result of the voice recognition by the voice recognition means, and inputting the generated synthetic voice to the output volume adjustment means 84. In this case, the voice input/output device serves as a voice recognition device.

Moreover, a microphone as an input device and a speaker as an output device may be contained in one enclosure.

Though the present invention has been described with reference to the above exemplary embodiments and examples, the present invention is not limited to the above exemplary embodiments and examples. Various changes understandable by those skilled in the art can be made to the structures and details of the present invention within the scope of the present invention.

This application claims priority based on Japanese Patent Application No. 2011-245615 filed on Nov. 9, 2011, the disclosure of which is incorporated herein in its entirety.

INDUSTRIAL APPLICABILITY

The present invention is suitable for use in a voice input/output device that prevents howling when outputting an input voice and a result of voice recognition of the voice.

REFERENCE SIGNS LIST

10, 20, 30, 40, 50 voice input/output device
11, 11*a*, 11*b* input volume adjustment unit
12, 12*a*, 12*b*, 12*c*, 12*d* monitoring volume adjustment unit
13, 13*c*, 13*d* output volume adjustment unit
14 control unit
15, 15*a*, 15*b* input voice separation unit
16, 16*a*, 16*b* input unit
17, 17*c*, 17*d* output unit
18 voice recognition unit
19 voice synthesis unit

The invention claimed is:

1. A voice input/output device comprising:

hardware comprising a processor configured to implement:

an input volume adjustment unit which adjusts a volume of an input voice input to an input device;

a voice separation unit which separates the input voice of the volume adjusted by the input volume adjustment unit, into a recognition voice used for voice recognition and a monitoring voice which is a voice used for monitoring the input voice;

a monitoring volume adjustment unit which adjusts a volume of the monitoring voice;

an output volume adjustment unit which adjusts a volume of an output voice and causing an output device to output the output voice of the adjusted volume, the output voice being a voice obtained by synthesizing a synthetic voice and the monitoring voice of the volume adjusted by the monitoring volume adjustment unit, the synthetic voice being a voice synthesized from information generated as a result of voice recognition of the recognition voice; and a control unit which instructs the monitoring volume adjustment unit to adjust the volume of the monitoring voice so that an amplification factor of the volume of the output voice with respect to the volume of the input voice does not exceed 1.

2. The voice input/output device according to claim 1, wherein the processor is further configured to implement:

at least two input volume adjustment units respectively provided for at least two input devices, each for adjusting a volume of an input voice input to a corresponding input device, wherein the monitoring volume adjustment unit adjusts a volume of a monitoring voice separated for each input voice, and wherein the control unit instructs the monitoring volume adjustment unit to adjust the volume of the monitoring voice so that the amplification factor of the volume of the output voice with respect to the volume of each input voice does not exceed 1.

3. The voice input/output device according to claim 1, wherein the processor is further configured to implement:

at least two output volume adjustment units respectively provided for at least two output devices, each for adjusting a volume of an output voice output from a corresponding output device, wherein the monitoring volume adjustment unit adjusts a volume of a monitoring voice for each output device, and wherein the control unit instructs the monitoring volume adjustment unit to adjust the volume of the monitoring voice so that an amplification factor of a total volume of the output voice output from each output device with respect to the volume of the input voice does not exceed 1.

4. The voice input/output device according to claim 2 or 3, wherein the processor is further configured to implement:

a selection unit which selects a combination of an input device to which an input voice is input and an output device from which a synthetic voice is output, wherein the monitoring volume adjustment unit adjusts a volume of a monitoring voice separated for the input voice input to each selected input device, and a volume of a monitoring voice for each selected output device, and wherein the control unit instructs the monitoring volume adjustment unit to adjust the volume of the monitoring voice so that an amplification factor of a total volume of the output voice output from each selected output device with respect to a volume of the input voice input to each selected input device does not exceed 1.

5. The voice input/output device according to claim 1, wherein the voice separation unit transmits the voice recognition to a voice recognition device wirelessly, and the output volume adjustment unit receives the synthetic voice transmitted wirelessly.

6. The voice input/output device according to claim 1, wherein the processor is further configured to implement:

a voice recognition unit which performs voice recognition based on the recognition voice; and a voice synthesis unit which generates the synthetic voice from a result of the voice recognition by the voice recognition unit, and inputting the generated synthetic voice to the output volume adjustment unit.

7. The voice input/output device according to claim 1, wherein a microphone as an input device and a speaker as an output device are contained in one enclosure.

8. A method for preventing howling, comprising:

adjusting a volume of an input voice input to an input device;

separating the input voice of the adjusted volume, into a recognition voice used for voice recognition and a monitoring voice used for monitoring the input voice;

adjusting a volume of the monitoring voice;

adjusting a volume of an output voice and causing an output device to output the output voice of the adjusted volume, the output voice being a voice obtained by synthesizing a synthetic voice and the monitoring voice of the adjusted volume, the synthetic voice being a voice synthesized from information generated as a result of voice recognition of the recognition voice; and adjusting the volume of the monitoring voice so that an amplification factor of the volume of the output voice with respect to the volume of the input voice does not exceed 1.

9. A non-transitory computer readable information recording medium storing a program for preventing howling, when executed by a processor, that performs a method for:

adjusting a volume of an input voice input to an input device;

separating the input voice of the adjusted volume, into a recognition voice used for voice recognition and a monitoring voice used for monitoring the input voice;

adjusting a volume of the monitoring voice;

adjusting a volume of an output voice and causing an output device to output the output voice of the adjusted volume, the output voice being a voice obtained by synthesizing a synthetic voice and the monitoring voice of the adjusted volume, the synthetic voice being a voice synthesized from information generated as a result of voice recognition of the recognition voice; and adjusting the volume of the monitoring voice so that an amplification factor of the volume of the output voice with respect to the volume of the input voice does not exceed 1.

10. The voice input/output device according to claim 2, wherein the processor is further configured to implement:

at least two output volume adjustment units respectively provided for at least two output devices, each for adjusting a volume of an output voice output from a corresponding output device, wherein the monitoring volume adjustment unit adjusts a volume of a monitoring voice for each output device, and wherein the control unit instructs the monitoring volume adjustment unit to adjust the volume of the monitoring voice so that an amplification factor of a total volume of the output voice output from each output device with respect to the volume of the input voice does not exceed 1.

11. The voice input/output device according to claim 3, wherein the processor is further configured to implement:

a selection unit which selects a combination of an input device to which an input voice is input and an output device from which a synthetic voice is output, wherein the monitoring volume adjustment unit adjusts a volume of a monitoring voice separated for the input voice input to each selected input device, and a volume of a monitoring voice for each selected output device, and wherein the control unit instructs the monitoring volume adjustment unit to adjust the volume of the monitoring voice so that an amplification factor of a total volume of the output voice output from each selected output device with respect to a volume of the input voice input to each selected input device does not exceed 1.

12. The voice input/output device according to claim 2, wherein the voice separation unit transmits the recognition voice to a voice recognition device wirelessly, and the output volume adjustment unit receives the synthetic voice transmitted wirelessly.

13. The voice input/output device according to claim 3, wherein the voice separation unit transmits the recognition voice to a voice recognition device wirelessly, and the output volume adjustment unit receives the synthetic voice transmitted wirelessly.

14. The voice input/output device according to claim 4, wherein the voice separation unit transmits the recognition voice to a voice recognition device wirelessly, and the output volume adjustment unit receives the synthetic voice transmitted wirelessly.

15. The voice input/output device according to claim 2, wherein the processor is further configured to implement:

a voice recognition unit which performs voice recognition based on the recognition voice; and a voice synthesis unit which generates the synthetic voice from a result of the voice recognition by the voice recognition unit, and inputting the generated synthetic voice to the output volume adjustment unit.

16. The voice input/output device according to claim 3, wherein the processor is further configured to implement:

a voice recognition unit which performs voice recognition based on the recognition voice; and a voice synthesis unit which generates the synthetic voice from a result of the voice recognition by the voice recognition unit, and inputting the generated synthetic voice to the output volume adjustment unit.

17. The voice input/output device according to claim 4, wherein the processor is further configured to implement:

a voice recognition unit which performs voice recognition based on the recognition voice; and a voice synthesis unit which generates the synthetic voice from a result of the voice recognition by the voice recognition unit, and inputting the generated synthetic voice to the output volume adjustment unit.

18. The voice input/output device according to claim 5, wherein the processor is further configured to implement:

a voice recognition unit which performs voice recognition based on the recognition voice; and a voice synthesis unit which generates the synthetic voice from a result of the voice recognition by the voice recognition unit, and inputting the generated synthetic voice to the output volume adjustment unit.

19. The voice input/output device according to claim 2, wherein a microphone as an input device and a speaker as an output device are contained in one enclosure.

20. The voice input/output device according to claim 3, wherein a microphone as an input device and a speaker as an output device are contained in one enclosure.

* * * * *